United States Patent [19]

Reeve

[11] Patent Number: 4,687,113

[45] Date of Patent: Aug. 18, 1987

[54] TAMPER EVIDENT CLOSURE

[75] Inventor: Randy F. Reeve, Upland, Calif.

[73] Assignee: Calmar, Inc., Watchung, N.J.

[21] Appl. No.: 890,278

[22] Filed: Jul. 29, 1986

[51] Int. Cl.[4] ..... B65D 41/46

[52] U.S. Cl. ..... 215/230; 215/250

[58] Field of Search ..... 215/230, 232, 203, 250

[56] References Cited

U.S. PATENT DOCUMENTS 3,480,169 11/1969 Hammes .
3,973,690 8/1976 Schneider ..... 215/350 X
4,553,678 11/1985 Thorsbakken ..... 215/203 X
4,564,117 1/1986 Herbert ..... 215/350 X
4,576,297 3/1986 Larson ..... 215/250

*Primary Examiner*—Donald F. Norton
*Attorney, Agent, or Firm*—Watson, Cole, Grindle & Watson

[57] ABSTRACT

The closure cap of a tamper evident closure is removably mounted on a container over a cap liner sealed to the container opening, the cap having a stud extending through the liner and supporting a brightly colored disc beneath the liner. The disc is visible through the ruptured liner incident to cap removal.

4 Claims, 6 Drawing Figures

TAMPER EVIDENT CLOSURE

BACKGROUND OF THE INVENTION

This invention relates generally to a tamper evident closure for a container in which a liner sealed over the container opening ruptures and is visually indicated incident to any attempt to remove the closure cap.

Most containers of, for example, medicants and comestibles have a moisture proof cap liner overlying the mouth of the container opening. The liner may be bonded to the container surrounding the opening so as to require the user to rupture or peel away the liner after cap removal to gain access to the container contents. And, any tampering with the container will be made self evident if the liner has been punctured or ruptured. However, once the cap is removed it is entirely possible that tampering could go unnoticed if the liner were to be carefully removed and replaced.

To avoid this drawback, various tamper evident closures have been developed such as that disclosed in U.S. Pat. No. 4,553,678 in which indicating film is applied to either the base of the container neck or to the underside of the container cap end wall such that, upon cap rotation, engagement of a cap flange or the projecting fingers of a separate bias spring with the film will rupture or score the same rendering any container tampering clearly visible.

U.S. Pat. No. 4,576,297 disclosed another tamper evident closure in which a cover of translucent material overlies the container liner bonded to the surface of the container which surrounds its opening, a spot of adhesive adhering the inside of the cover to the liner and being laterally offset from the central axis of the cover. Upon relative movement between the cover and the container the liner is caused to tear by the spot of adhesive to provide visual indication that the cap has been previously removed.

These prior approaches taken in evidencing a tampering or a previously open condition of the container are, however, not without their drawbacks. For example, tamper indicating material must be either specially applied to the base of the container neck, or if applied to the underside of the cap end wall a separate bias spring having projecting fingers must be employed. Otherwise, a torn or ruptured container liner may not always be visible to an unsuspecting operator even through a translucent cap. Besides, since both the aforementioned closure caps give immediate indication of tampering upon cap rotation, they are unsuitable for those closures in which it may be desirable to permit cap rotation without tamper indicating and before cap removal for non-screw caps such as those snap caps which must be rotated to a position of matching arrows between the cap and container before the cap is lifted off.

SUMMARY OF THE INVENTION

In accordance with the present invention, the tamper evident closure includes a rupturable liner bonded to the surface of the container surrounding the container opening, the disc being typically formed of a thin layer of aluminum which may be coated with a heat sealable layer such as polyethylene. A translucent or partially translucent container cap is removably mounted to the container over the liner, the cap having a support stud extending through the liner into the opening. A small tamper indicating disc, which may be of a bright or luminescent color, is supported on the stud beneath the liner but unattached thereto. Thus, an attempt to remove the cover from the container causes the liner to rupture in the vicinity of the stud as the stud and small disc shift laterally and/or axially relative to the liner, thereby exposing the small disc through the lid to visually indicate the removal attempt.

The stud may be coaxial with the cover permitting it to be rotated about its axis without causing liner rupture, although relative separation between the cover and container will bring about liner rupture, such as when a snap cap is employed.

Otherwise, the stud may be laterally spaced from the central axis of the cover, such that any attempt at cap removal by either relative rotation or separation between the cap and container will cause rupture of the liner.

DETAILED DESCRIPTION OF THE INVENTION

Figure 1:
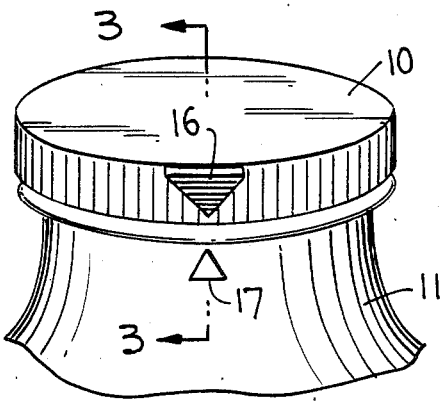
FIG. 1 is a perspective view of a snap cap removably mounted on the container and incorporating one embodiment of the invention.
Figure 2:
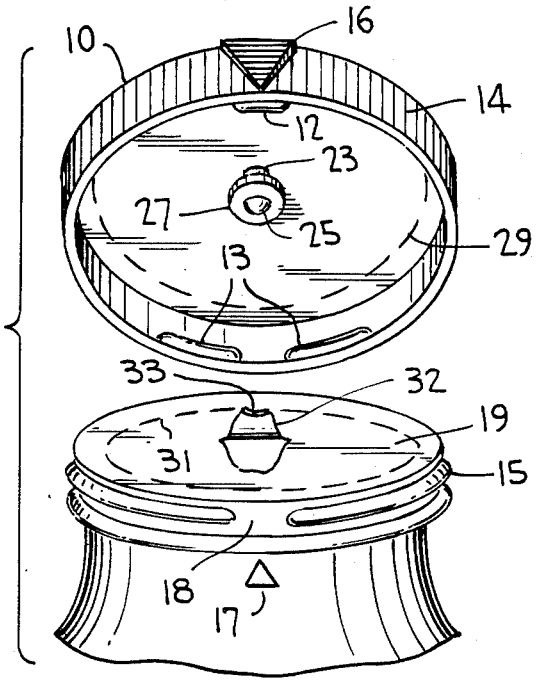
FIG. 2 is a view similar to FIG. 1 but showing the cap completely removed.
Figure 3:
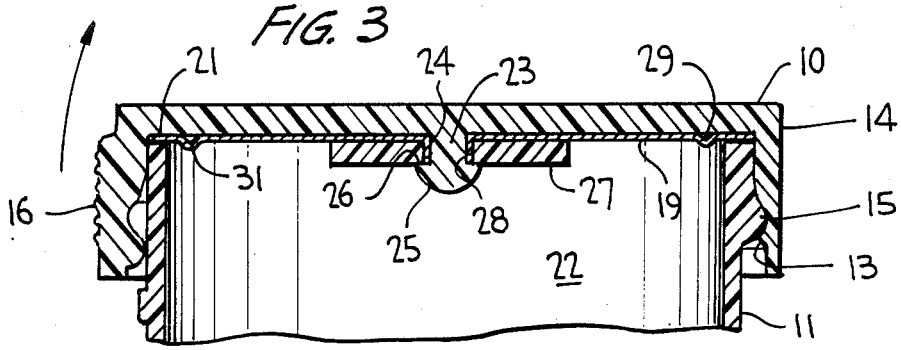
FIG. 3 is a sectional view taken substantially along the line 3—3 of FIG. 1.

Turning now to the drawings wherein like reference characters refer to like and corresponding parts throughout the several views, the tamper evident closure of the invention is shown in FIGS. 1 to 3, according to one embodiment, in which a closure cap or cover 10 is removably mounted on the neck of a container 11. The cap may be of the snap fitting variety in which inwardly directed snap beads 12, 13 on the inner suface of cap skirt 14 engage the underside of a split ring 15 on the outside of the container neck. A triangular thumb tab 16 on the cap skirt is aligned with triangular indicia 17, or the like, on the outside of the bottle neck upon cap rotation such that bead 12 is placed in registry with gap 18 of the split ring. The thumb tab is then pushed upwardly whereupon the cap may be lifted off the container. Typically the cap shifts slightly in a lateral direction as bead 12 is pushed through gap 18 upon cap removal.

The invention is not limited for use with the snap cap as aforedescribed, but may likewise be employed for a screw cap having internal threads in threaded engagement with the external threads (not shown) on the bottle neck.

A rupturable cap liner 19, which may typically be a thin layer of aluminum coated with a heat sealable layer such as polyethylene, is bonded along outer edge 21 of the container neck so as to completely cover container opening 22. The liner, which is opaque being of aluminum, provides a moisture proof seal as well a tamper proof covering for the container.

The closure cap has a support stud 23 which extends through an aperture 24 in the liner and into opening 22 of the container. The stud has an enlargement 25 at its distal end sized to present a shoulder 26 with the stud shank. A tampering indicating disc 27, having an opening 28, is supported through its opening on stud 23 beneath the liner and in engagement with shoulder 26. The disc may be of relatively rigid material and is formed to differ visually from the liner. For example, the disc may be of a bright or luminescent color such as orange, red or the like, and is unattached to the liner.

The liner is assembled and heat sealed along edge 21 in the normal manner. For this purpose, a continuous or discontinuous annular rib or ribs 29 are provided on the underside of the cap end wall. The ribs lie slightly inwardly of or opposite edge 21 for concentrating the sealing pressure and heat at this location. The cap liner is placed inside the cap and, in this case, is simply impaled over stud 23 so as to form aperture 24 through which the stud extends. Otherwise, the liner could be preformed with an aperture 24. Tamper indicating disc 27 is then simply snap fitted over enlargement 25. The liner is then heat sealed to the container along edge 21 by induction heating from outside the container cap, in the normal manner. Rib impressions 31 are typically made on the outside of the liner by ribs 29 during the assembly procedure.

Stud 23 may be integrally formed with the closure cap as shown, or may be mounted on the cap as a separate part. And, disc 27 may be mounted on the stud in any other manner equivalent to that aforedescribed, without departing from the invention. Moreover, disc 27 may be fused or otherwise attached to the stud during assembly to avoid a restructuring of the closure by a clever tamperer.

Figure 4:
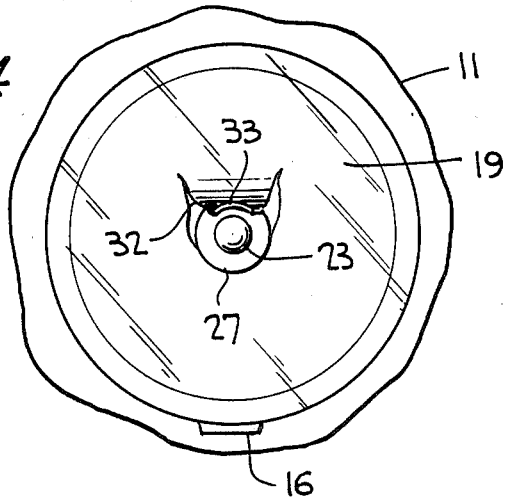
FIG. 4 is a top plan view of the closure of FIG. 1 illustrating the ruptured liner made visible upon tampering.

When removing the cap, tab 16 is aligned with indicia 17 permitting the cap to be lifted off in the normal manner as aforedescribed. In so doing, the cap liner is ruptured as at 32 (FIGS. 2 and 4), commencing with a tear 33 at aperture 24 of the liner by reason of the cap first shifting laterally relative to the container neck before being lifted off axially. If the cap is only partially removed sufficiently to gain access to the container contents and then snapped back into place, brightly colored disc 27 will be at least partially exposed to full view through the transluscent closure cap giving a clear indication of the attempt at removal. Otherwise, if the cap is completely removed as in FIG. 2, disc 27 will completely pull through the cap liner and, when the cap is snapped back into place, the disc will be exposed to full view through the cap visually indicating a cap removal.

And, upon cap removal, the ruptured liner affords easy access to the container contents by simply removing the liner from container neck edge 21.

In the embodiment of FIGS. 1 to 4, stud 23 is coaxial with the closure cap such that the cap may be rotated about its central axis without rupturing the liner since no attempt at cap removal need be indicated. And, if a screw cap is employed in place of the snap cap described, an initial loosening of the cap will not rupture the liner. After separation of the cap from the container upon further loosening, stud 23 and disc 27 will sufficiently tension the cap liner causing it to rupture starting at its aperture 24. Again, the brightly colored tamper indicating disc will be at least partially exposed through the ruptured liner to visually indicate at least an attempt at cap removal.

Figure 5:
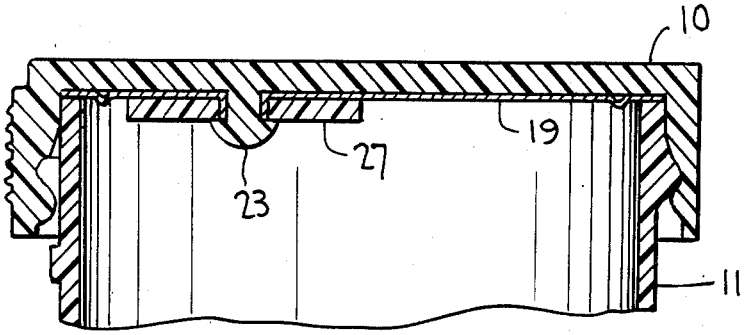
FIG. 5 is a view similar to FIG. 3 of another embodiment of the invention.
Figure 6:
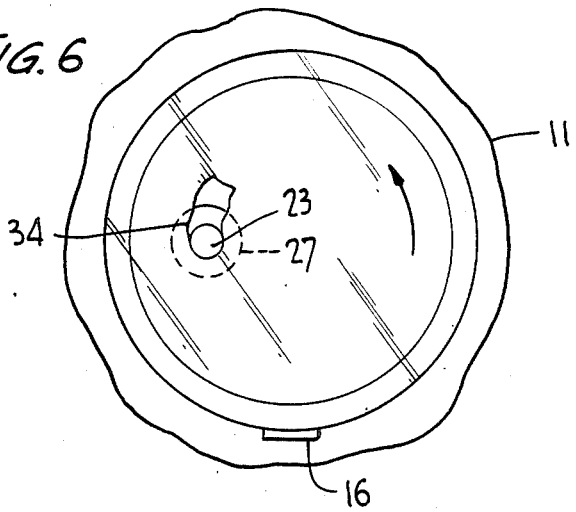
FIG. 6 is a view similar to FIG. 4 illustrating the ruptured liner made visible upon tampering.

In the embodiment of FIGS. 5 and 6, wherein like elements are represented by like reference numerals, the tamper evident closure is the same as that of FIGS. 1 to 4 except that stud 23 is laterally spaced from the central axis of the closure cap. Disc 27 is mounted on the stud in the same manner as described for the first embodiment. Thus, whether the closure cap is snap fitted or threaded mounted on the container, initial rotation in the loosening direction, as shown by the arrow in FIG. 6, causes the liner to rupture as at 34 as the stud traces a tear during cap turning. Thus, a portion of the brightly colored disc 27 becomes clearly visible through the tear indicating an attempt at cap removal.

Obviously, many modifications and variations of the present invention are made possible in the light of the above teachings. It is therefore to be understood that within the scope of the appended claims the invention may be practiced otherwise than as specifically described.

What is claimed is:

1. A closure for a container having an opening bounded by an outer surface, said closure comprising a cover removably mounted on said container and having an end wall overlying said opening, at least a portion of said end wall being of translucent material, a rupturable opaque liner secured to said outer surface over said opening, a support stud on said cover extending through said liner into said opening, a disc-like tamper indicating member supported on said stud beneath but unattached to said liner so as to be normally hidden from view, and said disc-like member and said liner being formed to differ visually whereby an attempt to remove said cover from said container causes said liner to rupture in the vicinity of said stud to thereby expose said disc-like member through said cover to visually indicate the removal attempt.

2. The closure according to claim 1, wherein said stud is coaxial with said cover permitting said cover to be rotated about its axis without causing the rupture of said liner, but relative separation between said cover and said container to a predetermined extent causes the rupture of said liner.

3. The closure according to claim 1, wherein said stud is laterally spaced from the central axis of said cover, whereby the attempt to remove said cover by either relative rotation of or separation between said cover and said container causes the rupture of said liner.

4. The closure according to claim 1, wherein said liner comprises a metal foil layer.

* * * * *